US010500838B2

(12) United States Patent
Egerton et al.

(10) Patent No.: US 10,500,838 B2
(45) Date of Patent: Dec. 10, 2019

(54) DECORATOR DRIVE AND PRINTING PLATE CYLINDER AUTOMATION

(71) Applicant: CROWN Packaging Technology, Inc., Alsip, IL (US)

(72) Inventors: Daniel Egerton, North Yorkshire (GB); Ian Wilkinson, Yorkshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 16 days.

(21) Appl. No.: 15/645,347

(22) Filed: Jul. 10, 2017

(65) Prior Publication Data

US 2018/0009216 A1 Jan. 11, 2018

Related U.S. Application Data

(60) Provisional application No. 62/360,865, filed on Jul. 11, 2016.

(51) Int. Cl.

| | |
|---|---|
| ***B41F 17/22*** | (2006.01) |
| ***B41F 17/08*** | (2006.01) |
| ***B41F 33/00*** | (2006.01) |
| ***B41N 10/02*** | (2006.01) |
| ***B41F 33/02*** | (2006.01) |
| ***B41F 13/004*** | (2006.01) |

(52) U.S. Cl.

CPC ..... *B41F 17/08* (2013.01); *B41F 13/0045* (2013.01); *B41F 17/22* (2013.01); *B41F 33/0036* (2013.01); *B41F 33/0081* (2013.01); *B41F 33/02* (2013.01); *B41N 10/02* (2013.01)

(58) Field of Classification Search

CPC ..... B41F 17/08; B41F 17/14; B41F 17/20; B41F 17/22

USPC ..... 101/38.1

See application file for complete search history.

(56) References Cited

U.S. PATENT DOCUMENTS

| | | | | |
|---|---|---|---|---|
| 3,828,668 A * | 8/1974 | Zugcic | B41F 17/22 101/40 |
| 4,491,613 A | 1/1985 | Hahn | |
| 5,193,456 A | 3/1993 | Wolfe et al. | |

(Continued)

FOREIGN PATENT DOCUMENTS

| | | |
|---|---|---|
| DE | 10 2013-206989 A1 | 10/2014 |
| DE | 10 2014-213805 B3 | 12/2014 |

(Continued)

*Primary Examiner* — Leslie J Evanisko

(74) *Attorney, Agent, or Firm* — BakerHostetler

(57) ABSTRACT

A can decorator comprising a spindle disc, a blanket drum, a transfer wheel, a pin chain drive, and a controller. The spindle disc is adapted for (i) receiving beverage cans from an infeed and (ii) carrying and rotating each can body on a corresponding spindle. The blanket drum is adapted for (i) applying ink to printing cylinders and (ii) rotating the print cylinders in registration with beverage cans on the spindle disc to decorate the cans. The transfer wheel is adapted for receiving beverage cans from the spindle disc after decoration by the blanket drum. The pin chain drive is adapted for receiving cans from the transfer wheel and transporting the cans on a chain through an oven. The controller adapted for receiving encoder information and matching or adjusting speeds of a spindle disc motor, a blanket drum motor, a transfer wheel motor, and a pin chain drive motor.

23 Claims, 2 Drawing Sheets

(56) References Cited

U.S. PATENT DOCUMENTS

| | | | | |
|---|---|---|---|---|
| 5,337,659 | A | 8/1994 | Whelan | |
| 2012/0216689 | A1* | 8/2012 | Cochran | B41F 17/22<br>101/39 |
| 2013/0087059 | A1* | 4/2013 | Baird | B41F 33/0027<br>101/416.1 |
| 2016/0229198 | A1* | 8/2016 | Izume | B41F 33/0045 |

FOREIGN PATENT DOCUMENTS

| | | | | |
|---|---|---|---|---|
| JP | WO 2015046119 | A1 * | 4/2015 | B41F 33/0045 |
| WO | WO 2012/054655 | A1 | 4/2012 | |
| WO | WO 2016087876 | A1 * | 6/2016 | B41F 13/14 |

* cited by examiner

DECORATOR DRIVE AND PRINTING PLATE CYLINDER AUTOMATION

CROSS-REFERENCE TO RELATED APPLICATIONS

This application claims the benefit of and priority to U.S. Provisional Application No. 62/360,865, filed Jul. 11, 2016, the entirety of which is incorporated herein by reference for any and all purposes.

BACKGROUND

Beverage cans are produced in massive quantities in high speed equipment. One aspect of modern beverage can manufacturing is can decoration in a specialized machine referred to as a decorator. An example of a prior art decorator is shown in U.S. Pat. No. 5,337,659. Commercial can decorators are sold, for example, by Stolle Machinery and Formatec.

As described in the 659 patent, many commercial can decorators include an infeed conveyor that receives cans from a can supply and directs them to accurate cradles or pockets along the periphery of a pocket wheel. The pocket wheel is fixed to a continuously rotating mandrel carrier wheel or spindle disc, which in turn is fixed to a continuously rotating horizontal drive shaft. Horizontal spindles or mandrels, each being pivotable about its own axis, are mounted to the mandrel carrier wheel adjacent its periphery.

While mounted on the mandrels, the cans are decorated by being brought into engagement with a blanket (e.g., without limitation, a replaceable adhesive-backed piece of rubber) that is adhered to a blanket segment of the multicolor printing unit. The blankets are carried by a blanket drum. Then the outside of each decorated can is coated with a protective film of varnish applied by an overvarnish unit. The decorated and coated cans are transferred from the mandrels to a transfer wheel and then to generally horizontal pins carried by a chain-type output conveyor, which carries the cans through a curing oven.

Conventional decorators are driven by a single motor and a series of shafts, tensioners, chains/belts and gearboxes to each of the four main shafts (that is, the shafts for the blanket drum, spindle disc, transfer wheel, and pin chain drive). In other words, the drives are mechanically linked and once the relative timing positions to each other are set, they rarely move. The overvarnish unit shaft is driven by a separate motor (that is, prior art overvarnish units are not mechanically linked to the drive system that mechanically drives the blanket drum, spindle disc, transfer wheel, and pin chain drive) to provide different speeds to allow different numbers of 'wraps' or coatings of varnish depending on customer specification.

Regarding applying images to the cans, while moving toward engagement with an undecorated can, the blanket engages a plurality of printing cylinders, each of which is associated with an individual ink station assembly or inker. Each inker produces a controlled film of ink that is applied to the printing cylinder. Typically, each inker provides a different color ink and each printing cylinder applies a different image segment to the blanket. All of these image segments combine to produce the same main image that is transferred to the can body. Accordingly, registration of the print cylinders is crucial to image quality.

A common way for operators to register the print cylinders is to inspect the can image at the blow off position, then manually adjust the radial and axial registration close to the plate cylinder on the machine underneath the inking units. This is normally by a platform that is in front of the colour section.

For each plate cylinder there are two mechanical assemblies that either push/pull the plate cylinder for the axial registration or rotate the plate cylinder for radial registration. The operator uses various tools to loosen the assembly allowing it to move and then reverses the process for tightening it. This process of adjusting the axial and radial position of the plate cylinder can be repeated several times in each inker position to register the image. Typically a can may have anything from 4 to 8 colours and therefore the registration process is repeated for the number of colours being used.

Typically there are two operators that perform the registration operation. One operator is on the platform and one close to the blow off point where the printed cans are inspected. The operator at the blow off point collects two cans, inspects one and throws the other to his colleague on the platform. After a discussion and assessment of the image, they agree on what needs to move and by how much. The operator then makes the manual adjustments until both are happy with the registration in all positions. The process of determining the quality of the image and determining the direction and magnitude of the axial and radial adjustments of the plate cylinders requires skill and experience.

SUMMARY OF THE INVENTION

A can decorator includes independent servo motors to drive each of the main four axes independently. Preferably a servo motor directly drives the blanket drum. And each one of the spindle disc, transfer wheel and pin chain drive is driven by its own servo motor, preferably through its own planetary gearbox. Preferably, the inkers and over varnish will be separately driven. A virtual master controller preferably adjusts each motor to match the relative speeds. Inker speed is a function of the overall speed and is adjusted accordingly.

The servo motors are fitted with encoders, preferably absolute encoders, and have condition monitoring features that feedback to the HMI including temperature, vibration, and efficiency (that is, power consumption). The present invention preferably is implemented for decorating beverage can bodies before formation of a neck, and the present invention encompasses other can bodies, such as other drawn and wall ironed can bodies, and the like.

According to a first embodiment, a can decorator comprises: a spindle disc adapted for (i) receiving beverage cans from an infeed and (ii) carrying and rotating each can body on a corresponding spindle; the spindle disc being driven by a spindle disc motor having an encoder; a blanket drum adapted for (i) applying ink to printing cylinders and (ii) rotating the print cylinders in registration with beverage cans on the spindle disc to decorate the cans; the blanket drum being driven by a blanket drum motor having an encoder; a transfer wheel adapted for receiving beverage cans from the spindle disc after decoration by the blanket drum; the transfer wheel being driven by a transfer wheel motor having an encoder; a pin chain drive adapted for receiving cans from the transfer wheel and transporting the cans on a chain through an oven; the pin chain drive being driving by a pin chain drive motor having an encoder; and a controller adapted for receiving encoder information and matching or adjusting speeds of the spindle disc motor, the blanket drum motor, the transfer wheel motor, and the pin chain drive motor.

Preferably any one of the encoder of the motors is an absolute encoder, and preferably the encoder on each one of the motors is an absolute encoder. Preferably the motors are servo motors. Each one of the motors may be capable of being operated while the other motors are off, whereby the operating motor is operable for maintenance tasks. The can decorator may also include an over-varnish disc adapted for applying a varnish to the cans while on the spindle disc.

In operation, and according to a method of operating the can decorator described above, the speed of at least one of the spindle disc motor, the blanket drum motor, transfer wheel motor, and pin chain drive motor may be adjusted to response to can image information to enhance the can image. Further, a pin chain in the can decorator may be changed by rotating the pin chain drive by engaging the pin chain drive motor without rotating the spindle disc, blanket drum, and transfer wheel. The blanket drum may be serviced or maintained by rotating the blanket drum by engaging the blanket drum motor without rotating the spindle disc, transfer wheel, and pin chain drive.

According to another aspect of the invention, a blanket drum in a can decorator includes: printing cylinders; inkers for providing ink to the printing cylinders; blankets for receiving ink from the printing cylinders; an axial actuator adapted for axially positioning the printing cylinder; and a radial actuator adapted for radially positioning the printing cylinder. The axial actuator and the radial actuator adjust the positioning of the printing cylinder to register an image relative to beverage cans based on inputs into a control system.

Preferably, the axial actuator and the radial actuator are servo motors. The input for controlling the actuators may be entered in a human-machine interface based on human observations, may be entered in a human-machine interface based on measurements of can images from a microscope, may be from cameras that image the can after printing, which imaging may automatically fed to the actuators, with or without human operator action. The blanket has plural printing cylinders, and each one of the printing cylinder has an axial actuator and a radial actuator.

According to another aspect of the present invention, the blanket drum described above may be adjusted by the steps of: determining target adjustments to the axial and/or radial position of at least one of the printing cylinders; sending a signal to the axial actuator and/or radial actuator associated with the at least one printing cylinder; and adjusting the axial and/or radial position by movement of the axial actuator and/or radial actuator in response to the signal. The determining step may include: human action of ascertaining image registration and entering adjustment data into an interface of a control system that generates the signal and performs the sending step. The determining step may include human action of ascertaining image registration through a microscope and entering adjustment data into an interface of a control system that generates the signal and performs the sending step. The determining step may also include a camera ascertaining image registration information, determining adjustment data based on image registration information, and creating the signal based on the image registration information. Again, preferably the axial actuator is a servo motor and the radial actuator is a servo motor, and wherein the servo motors operate to perform the adjusting step.

DESCRIPTION OF PREFERRED EMBODIMENT

Figure 1:
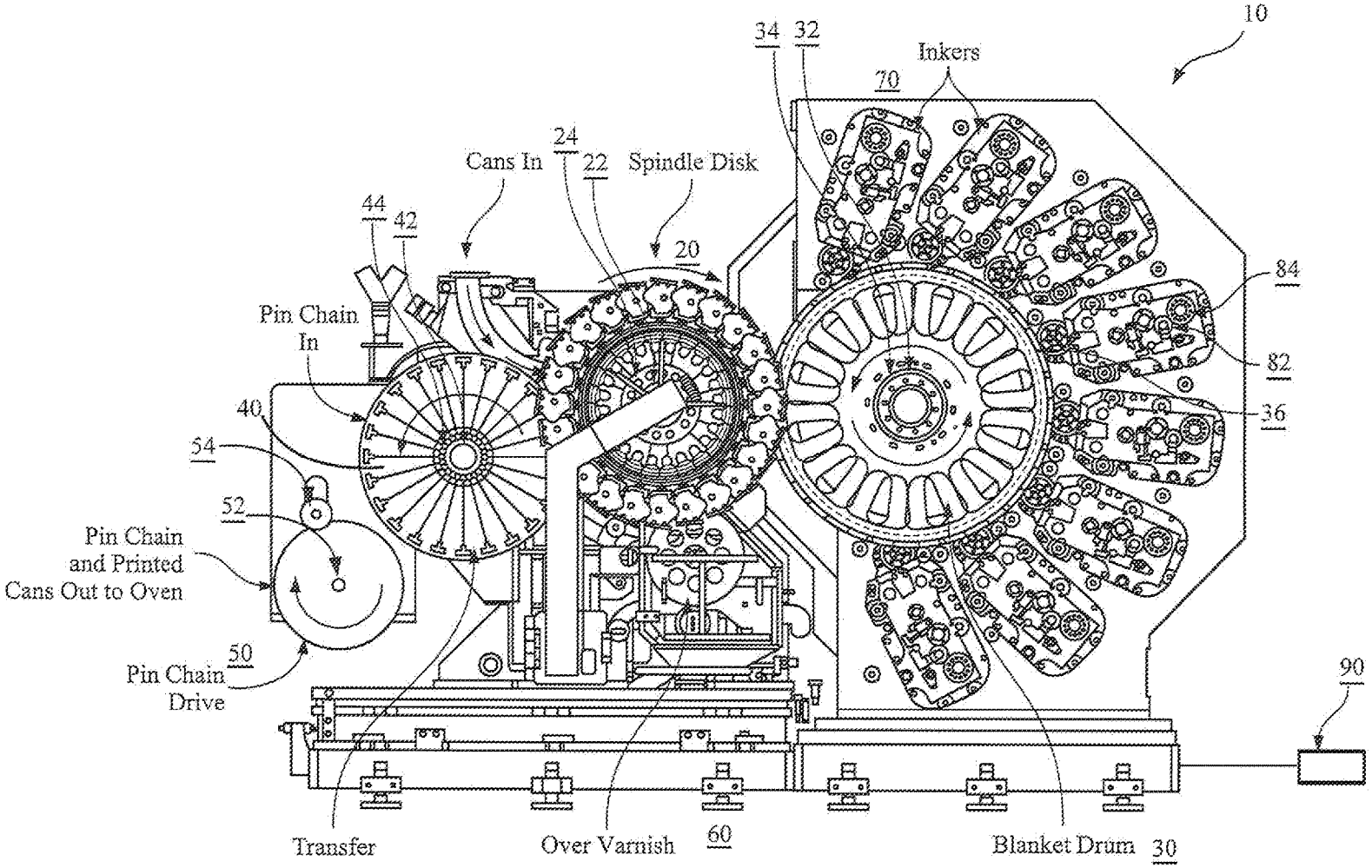
FIG. 1 is a schematic side view of a beverage can decorator according to an aspect of the invention.

A beverage can decorator 10 includes a spindle disc 20, a blanket drum 30, a transfer wheel 40, a pin chain assembly 50, an over-varnish system 60, and several inkers 70. Each one of the spindle disc 20, blanket drum 30, transfer starwheel 40, pin chain assembly 50, and over-varnish system 60 may employ mechanical parts or systems that are conventional, such as those that are supplied by Stolle Machinery (such as those marketed under the tradename Concord and Rutherford or Formatec), as will be understood by persons familiar with beverage can decorator technology.

Referring to FIG. 1, undecorated can bodies are first fed to spindle disc 20 from a can infeed conveyor. Spindle disc 20 carries the can bodies on a mandrel or spindle assembly into contact with a printing blanket of the blanket drum 30. Spindle disc 20 has a central shaft that is connected to a spindle disc servo motor 22 that has an encoder 24, preferably an absolute encoder. The term "encoder" is used in herein to refer to any device for determining the location of a shaft or rotor, such as conventional incremental encoders and absolute encoders, which will be understood by persons familiar with rotating machinery and electric motors.

Blanket drum 30 rotates radially within plural inking systems that supply ink and an image to the printing blankets 36. Each inker 70 is associated with one color ink and each inker is associated with its own printing cylinder 80 that rotates in registration with other components. The blanket drum has a shaft driven by a blanket drum servo motor 32 that has an absolute encoder 34.

While the can bodies are on the spindle disc 20 and after contact with the printing blankets, the cans receive an overvarnish from the overvarnish system 60, which preferably is conventional and includes its own servo motor that is controlled according to conventional parameters.

The cans exit the spindle disc 20 after the overvarnish application when they are handed off to transfer wheel 40, which has a shaft driven by a transfer wheel servo motor 42 having an absolute encoder 44.

The cans are handed off from transfer wheel 40 onto a pin chain that is operated by a pin chain drive 50. The decorated and varnished cans are moved on the pin chain through a conventional curing oven. Pin chain drive 50 has a shaft driven by a pin chain drive servo motor 52 that has an absolute encoder 54.

A controller 90 receives encoder information and matches or adjusts speeds or positions of the spindle disc motor 22, the blanket drum motor 32, the transfer wheel motor 42, and/or the pin chain drive motor 52, as needed. Further, any or all of the spindle disc motor 22, the blanket drum motor 32, the transfer wheel motor 42, and the pin chain drive motor 52 preferably have condition monitoring features, including temperature, vibration, and efficiency (that is, power consumption), that feed back to the controller 90 and/or human-machine interface.

Having individual servo motors on any or all of the axes also allows shafts to be driven or jogged separately. Thus, any or all of the spindle disc 20, blanket drum 30, transfer starwheel 40, pin chain assembly 50, and overvarnish system 60 can alone be serviced, maintained, or repaired without turning the others. For example, when changing the pin chain, the pin chain can be driven without moving the other components of the machine. Similarly, if blanket drum 30 requires service, maintenance, or repair (such as, when changing blankets, labels and inkers), blanket drum 30 can be run or positioned independently—without moving other components. The capability of moving only one of the spindle disc 20, blanket drum 30, transfer starwheel 40, and pin chain assembly 50 is different than conventional decorators, for which when maintenance is needed, there is one operator whose task is to bar the machine over, moving all the mechanical components together.

Another advantage includes being able to adjust the timing of each part of the machine. For example at the transfer position a decorated can be blown off a mandrel onto a pad with a suction cup that holds the can until it is transferred onto the pin chain. The system described herein can adjust the position of this change-over point, such as by adjustment of the relative speeds or position, during operation. Previously, it would have meant removing the transfer wheel at the front and rotating slightly before re-fitting.

Figure 2:
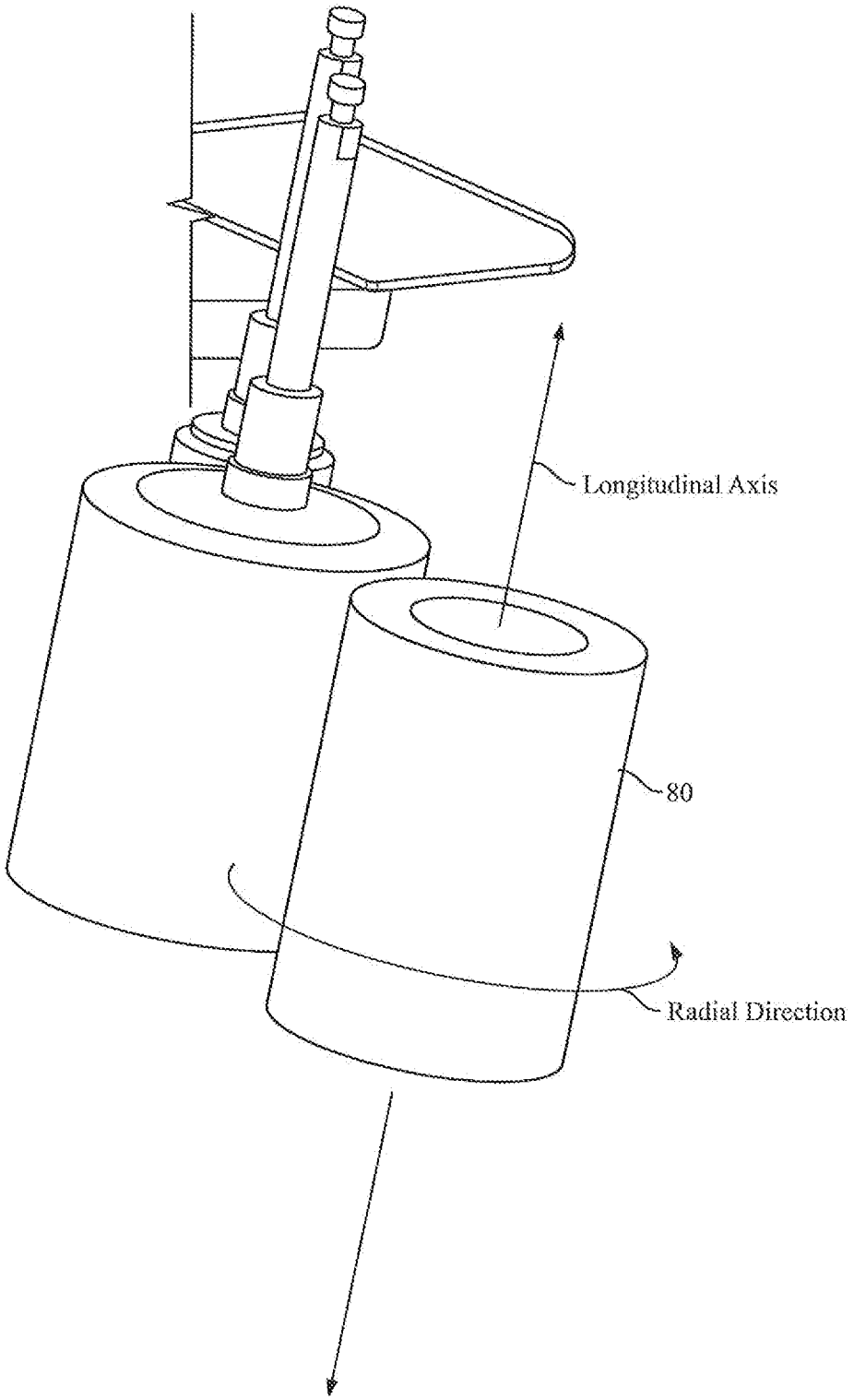
FIG. 2 is a view of a plate cylinder.

According to another aspect of the present invention, a blanket drum of a can decorator (preferably a beverage can decorator) includes servo motors for moving the plate cylinders to adjust the axial and radial positions of the print cylinders. Referring to FIG. 2, after the operators inspect the image of the can and determine that a plate cylinder requires adjustment, the plate cylinder may be axially or longitudinally moved forward or rearward by one or more servo motors, and also may be moved radially (that is, rotated) by one or more servo motors. The plate cylinder system includes servo motors 82 to move or slide the plate cylinder axially, and a servo motor 84 to move the plate cylinder radially. Preferably the plate cylinder servo motors are positioned at the back of the machine to allow greater access around the plate cylinder assembly at the front of the machine.

Optionally, a microscope (or like device) may be used to measure the amount of registration adjustment an image requires. The control on the HMI would allow the operator to set the measured amount and move the plate cylinders via the servo motors accordingly. Moreover, another option is for automatic registration measurement via a series of cameras in a position after the can has been fully printed. The registration could therefore be constantly monitored and adjusted accordingly while the machine is running.

The present invention is described with reference to particular embodiments. The present invention is not intended to be limited to the particular embodiments or combinations set out in the embodiments. For merely one example, the description states that each of several shafts has its own servo motor, but the present invention is not limited to all the shafts having a servo motor, and encompasses any combination thereof.

The invention claimed is:

1. A can decorator comprising:

a spindle disc adapted for (i) receiving beverage cans from an infeed and (ii) carrying and rotating each can body on a corresponding spindle; the spindle disc being driven by a spindle disc motor having an encoder;

a blanket drum that includes a plurality of printing blankets, the blanket drum adapted for (i) receiving ink on the plurality of printing blankets from printing cylinders and (ii) rotating the plurality of printing blankets in registration with beverage cans on the spindle disc to decorate the cans, wherein each of the plurality of printing blankets corresponds to one of the corresponding spindles of the spindle disc; the blanket drum being driven by a blanket drum motor having an encoder;

a transfer wheel adapted for receiving beverage cans from the spindle disc after decoration by the blanket drum; the transfer wheel being driven by a transfer wheel motor having an encoder;

a pin chain drive adapted for receiving cans from the transfer wheel and transporting the cans on a chain through an oven; the pin chain drive being driven by a pin chain drive motor having an encoder; and a controller adapted for receiving encoder information and matching or adjusting speeds of the spindle disc motor, the blanket drum motor, the transfer wheel motor, and the pin chain drive motor, individually, to improve print quality of the decoration applied by each of the plurality of printing blankets onto each can body positioned on the corresponding spindle.

2. The can decorator of claim 1 wherein the encoder on at least one of the motors is an absolute encoder.

3. The can decorator of claim 1 wherein the encoder on each one of the motors is an absolute encoder.

4. The can decorator of claim 1 wherein the motors are servo motors.

5. The can decorator of claim 1 further comprising an over-varnish disc adapted for applying a varnish to the cans while on the spindle disc.

6. The can decorator of claim 1 wherein each one of the motors is capable of being operated while the other motors are off, whereby the operating motor is operable for maintenance tasks.

7. A method of operating the can decorator of claim 1, comprising the step of adjusting a speed of one of the spindle disc motor, the blanket drum motor, transfer wheel motor, and pin chain drive motor in response to can image information to enhance a can image.

8. A method of changing a pin chain in the can decorator of claim 1, comprising the step of rotating the pin chain drive by engaging the pin chain drive motor without rotating the spindle disc, blanket drum, and transfer wheel.

9. A method of a servicing or maintaining a blanket drum in the can decorator of claim 1, comprising the step of rotating the blanket drum by engaging the blanket drum motor without rotating the spindle disc, transfer wheel, and pin chain drive.

10. The can decorator of claim 1 wherein the spindle disc is positioned relative to the transfer wheel such that an adjustment of speed of the spindle disc relative to a speed of the transfer wheel adjusts a change-over point between the spindle disc and the transfer wheel.

11. A can decorator comprising:

a blanket drum assembly comprising:

printing cylinders;

inkers for providing ink to the printing cylinders;

a plurality of blankets for receiving ink from the printing cylinders;

a blanket drum motor for rotating the blankets into contact with the printing cylinders;

axial actuators adapted for axially positioning the printing cylinders; and radial actuators adapted for radially positioning the printing cylinders;

whereby the axial actuators and the radial actuators adjust the positioning of the printing cylinders to register an image relative to beverage cans based on at least one input into a control system; and a spindle disc adapted for carrying each of the beverage cans on a corresponding spindle and placing each of the beverage cans into contact with a respective one of the plurality of blankets to decorate the beverage cans, the spindle disc being driven by a spindle disc motor, wherein a speed of the spindle disc motor and a speed of the blanket drum motor are individually adjustable by the control system to improve print quality of the decoration applied by each of the plurality of printing blankets onto each beverage can positioned on the corresponding spindle.

12. The can decorator of claim 11 wherein the axial actuators and the radial actuators are servo motors.

13. The can decorator of claim 11 wherein the at least one input for controlling the actuators is entered in a human-machine interface based on human observations.

14. The can decorator of claim 11 wherein the at least one input for controlling the actuators is entered in a human-machine interface based on measurements of can images from a microscope.

15. The can decorator of claim 11 wherein the at least one input for controlling the actuators is from cameras that image the can after printing.

16. The can decorator of claim 15 wherein the at least one input from the imaging is automatically fed to the actuators, with or without human operator action.

17. A method of adjusting a position of the printing cylinders in the can decorator of claim 11, comprising the steps of:

determining target adjustments to the axial and/or radial position of at least one of the printing cylinders;

sending a signal to the axial actuator and/or radial actuator associated with the at least one printing cylinder; and adjusting the axial and/or radial position by movement of the axial actuator and/or radial actuator in response to the signal.

18. The method of claim 17 wherein the determining step includes human action of ascertaining image registration and entering adjustment data into an interface of a control system that generates the signal and performs the sending step.

19. The method of claim 17 wherein the determining step includes human action of ascertaining image registration through a microscope and entering adjustment data into an interface of a control system that generates the signal and performs the sending step.

20. The method of claim 17 wherein the determining step includes a camera ascertaining image registration information, determining adjustment data based on image registration information, and creating the signal based on the image registration information.

21. The method of claim 17 wherein each axial actuator is a servo motor and each radial actuator is a servo motor, and wherein the servo motors operate to perform the adjusting step.

22. The can decorator of claim 11 wherein each one of the printing cylinders has an axial actuator and a radial actuator.

23. The can decorator of claim 11 further comprising a transfer wheel adapted for receiving beverage cans from the spindle disc after decoration by the blanket drum, the transfer wheel being driven by a transfer wheel motor having an encoder, and wherein the spindle disc is positioned relative to the transfer wheel such that an adjustment of speed of the spindle disc relative to a speed of the transfer wheel adjusts a change-over point between the spindle disc and the transfer wheel.

* * * * *